US005181619A

United States Patent [19]

Noble

[11] Patent Number: 5,181,619

[45] Date of Patent: Jan. 26, 1993

[54] APPARATUS AND SYSTEM FOR STORING AND COLLECTING SEPARATED SOLID WASTE

[76] Inventor: John W. Noble, 1742 Tanglewood Dr., NE., St. Petersburg, Fla. 33702

[21] Appl. No.: 645,095

[22] Filed: Jan. 24, 1991

[51] Int. Cl.[5] ..... B07C 7/04

[52] U.S. Cl. ..... 209/702; 209/706; 209/930; 220/521; 220/909

[58] Field of Search ..... 209/702, 706, 930, 933; 220/501, 522, 908, 909, DIG. 6

[56] References Cited

U.S. PATENT DOCUMENTS

| | | | |
|---|---|---|---|
| 1,475,483 | 11/1923 | Galuska | 280/79.2 |
| 3,414,157 | 12/1968 | Wright | 220/521 |
| 3,823,973 | 7/1974 | Ramer | 294/73 |
| 3,837,512 | 9/1974 | Brown | 214/302 |
| 4,042,142 | 8/1977 | Ruano | 220/DIG. 6 X |
| 4,113,125 | 9/1978 | Schiller | 214/302 |
| 4,768,670 | 9/1988 | Lin | 220/1 T |
| 4,809,897 | 3/1989 | Wright, Jr. | 220/521 X |
| 4,826,013 | 5/1989 | Heikkinen | 206/518 |
| 4,923,702 | 5/1990 | Powell et al. | 220/521 |
| 5,035,563 | 7/1991 | Mezey | 220/909 X |
| 5,072,852 | 12/1991 | Smith et al. | 220/909 X |
| 5,092,480 | 3/1992 | Waterston | 220/909 X |
| 5,127,523 | 7/1992 | Herdlicka | 220/908 X |

FOREIGN PATENT DOCUMENTS

| | | | |
|---|---|---|---|
| 3524781 | 1/1987 | Fed. Rep. of Germany | 220/909 |
| 2038619 | 7/1980 | United Kingdom | 220/908 |

*Primary Examiner*—Andres Kashnikow
*Assistant Examiner*—Joseph A. Kaufman
*Attorney, Agent, or Firm*—Willian Brinks Olds Hofer Gilson & Lione

[57] ABSTRACT

An apparatus and system for storing and collecting separated solid waste. The apparatus is a chambered container which includes a container body defining a first chamber for receiving a first waste, and a lid covering an open end of the body. The lid includes a base portion for defining a second chamber for receiving a second waste and a cover for covering the base portion. The system further includes a collection vehicle divided into two compartments, a robot arm for hoisting the chambered container up and over the vehicle, and a pair of guide rails for engaging the lid of the container for causing the contents of the first chamber to fall into one compartment of the vehicle and for causing the contents of the second chamber to fall into the other compartment of the vehicle.

12 Claims, 6 Drawing Sheets

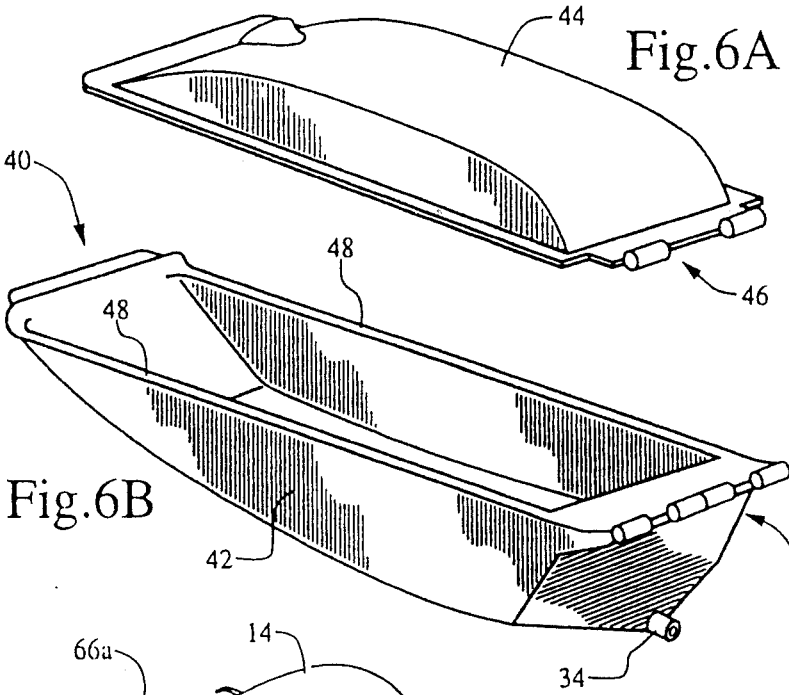
Fig.6A
Fig.6B
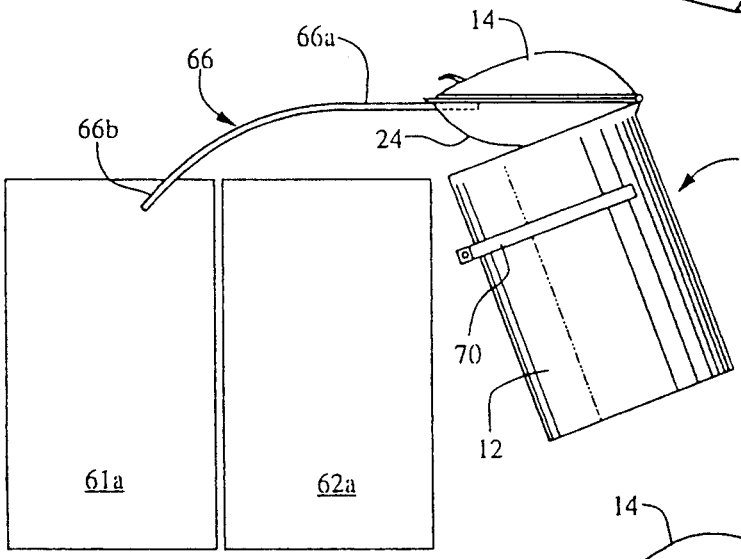
Fig.9A
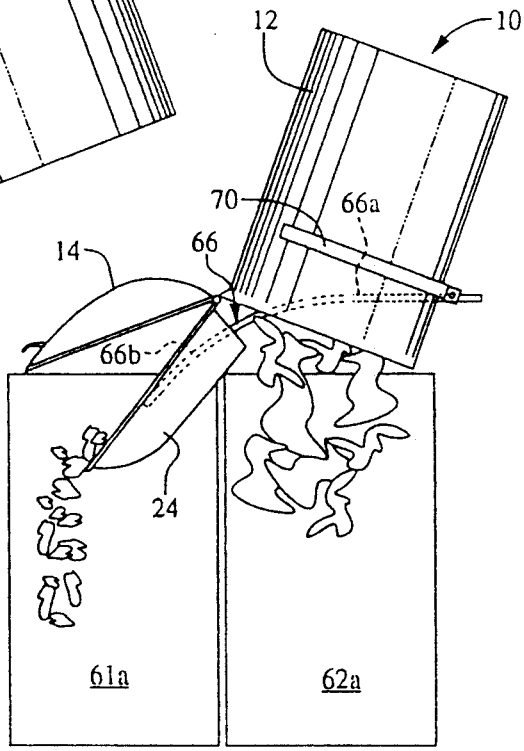
Fig.9B

APPARATUS AND SYSTEM FOR STORING AND COLLECTING SEPARATED SOLID WASTE

BACKGROUND OF THE INVENTION

1. Field of the Invention

The present invention relates generally to an apparatus and system for storing and collecting separated solid waste; and, more particularly, to a chambered container for storing separated solid waste and to a system for collecting prior separated solid waste.

2. Field of the Invention

It is well known that many waste products are recyclable; that is, they can be reprocessed into new products at a small fraction of their original cost of manufacture. This results in a substantial savings to both the manufacturer and the consumer and significant conservation of valuable natural resources.

A substantial quantity of recyclable waste, for example, aluminum cans, glass, various plastic articles, paper, etc. is generated by consumers; however, consumers usually dispose of this waste by placing it into trash cans or bags along with their ordinary trash to be picked up and disposed of by a municipal or private trash collection agency. Because the recyclable waste is mixed in with ordinary trash, separation of the recyclable articles from the ordinary trash is difficult, and the recyclable waste is usually disposed of by the collection agency either by being incinerated or by being deposited into a landfill along with the ordinary trash.

Procedures are available whereby the consumer can separate his recyclable waste from ordinary trash. Typically, however, the consumer must further separate different types of recyclable waste from one another and either deliver the separated recyclable waste to specific collection points or have them separately picked up. This is an inconvenient and time-consuming chore and, as a result, many consumers do not practice this procedure.

Containers having a plurality of sections or compartments for separately storing different types of trash are known in the art. See, for example, U.S. Pat. No. 4,826,013. Typically, however, such containers are rather large and bulky requiring substantial space and being difficult to handle. Also, the incorporation of such containers into a conventional trash collection system can significantly complicate the trash collection process. For example, the handling of such containers usually requires rather substantial modification of the trash collection vehicle.

SUMMARY OF THE INVENTION

The present invention provides an apparatus and system for storing and collecting separated solid waste that facilitates both storage of separated solid waste by the consumer and its collection by a trash collection agency.

An apparatus for storing separated solid waste according to the present invention comprises a chambered container which includes a container body defining a first chamber therein for receiving a first solid waste; and a lid for covering the first chamber, the lid defining a second chamber therein for receiving a second solid waste.

In accordance with a presently preferred embodiment, the first chamber in the container body is adapted to receive normal garbage or a bulky recyclable such as yard waste or the like; and the second chamber in the lid is adapted to receive bagged recyclables such as aluminum cans, glass bottles or the like.

In accordance with a presently preferred embodiment, the lid includes a base portion for defining at least a portion of the second chamber, and a cover for covering the base portion and closing the second chamber. The lid is attached to the container body by a first hinge means for pivotal movement between a first, closed position covering the container body and closing the first chamber, and a second, open position providing access to the first chamber. The cover is attached to the base portion by a second hinge means for pivotal movement between a first, closed position closing the second chamber and a second, open position providing access to the second chamber.

Preferably, the cover is dome-shaped to define with the base portion a clam-shell configuration for the lid so as to maximize the capacity of the second chamber.

With the chambered container of the present invention, to deposit waste into the first chamber, the consumer simply raises the entire lid and deposits the trash into the first chamber. To deposit waste into the second chamber, the consumer merely lifts the cover of the lid while the lid is in its first, closed position to provide access to the second chamber.

The chambered container of the present invention is compact in size in that it occupies substantially the same space as a conventional trash container. It is also easy to use and thus provides a convenient way for the consumer to separate recyclable waste from ordinary trash.

In accordance with a second aspect of the invention, a system for collecting prior separated solid waste is provided which includes a container having first and second chambers for storing first and second waste, and a collection vehicle for collecting the first and second waste. The vehicle includes first and second compartments for receiving the first and second waste and includes robot arm means for hoisting the container up and over the vehicle to empty the first and second waste into the vehicle, and guide means for engaging the container and for directing waste from the first chamber of the container into the first compartment of the vehicle and for directing waste from the second chamber of the container into the second compartment of the vehicle.

In accordance with a presently preferred embodiment, a container of the present invention is picked up by a conventional robot arm provided on the vehicle and as it is hoisted up above the vehicle and turned over by the robot arm to empty the contents of the container into the vehicle; the lid of the container will contact spaced guide rails positioned on the vehicle. The guide rails include a first portion arranged to initially maintain the lid substantially horizontal while the container body continues to be turned over; and as the body of the container continues to be turned, the contents of the first chamber fall by gravity into the first compartment of the vehicle. Thereafter, a second portion of the guide rails are arranged to allow the lid itself to turn so as to empty the contents of the second chamber into the second compartment of the vehicle.

With the system of the present invention, separated solid waste can be automatically collected and maintained in separated form without requiring any substantial modification or redesign of conventional trash collection vehicles, making the system highly convenient and economically efficient to municipal or private trash collection agencies.

Further important features and specific details of the invention will be set forth hereinafter in conjunction with the following detailed description of a presently preferred embodiment.

BRIEF DESCRIPTION OF THE DRAWINGS

FIGS. 6A and 6B are perspective views of the cover and base portions of a lid for a chambered container according to a second embodiment of the invention;

FIGS. 9A and 9B are side views schematically illustrating the operation of guide rails incorporated in the vehicle of FIGS. 7 and 8.

DETAILED DESCRIPTION OF THE PREFERRED EMBODIMENT

Figure 1:
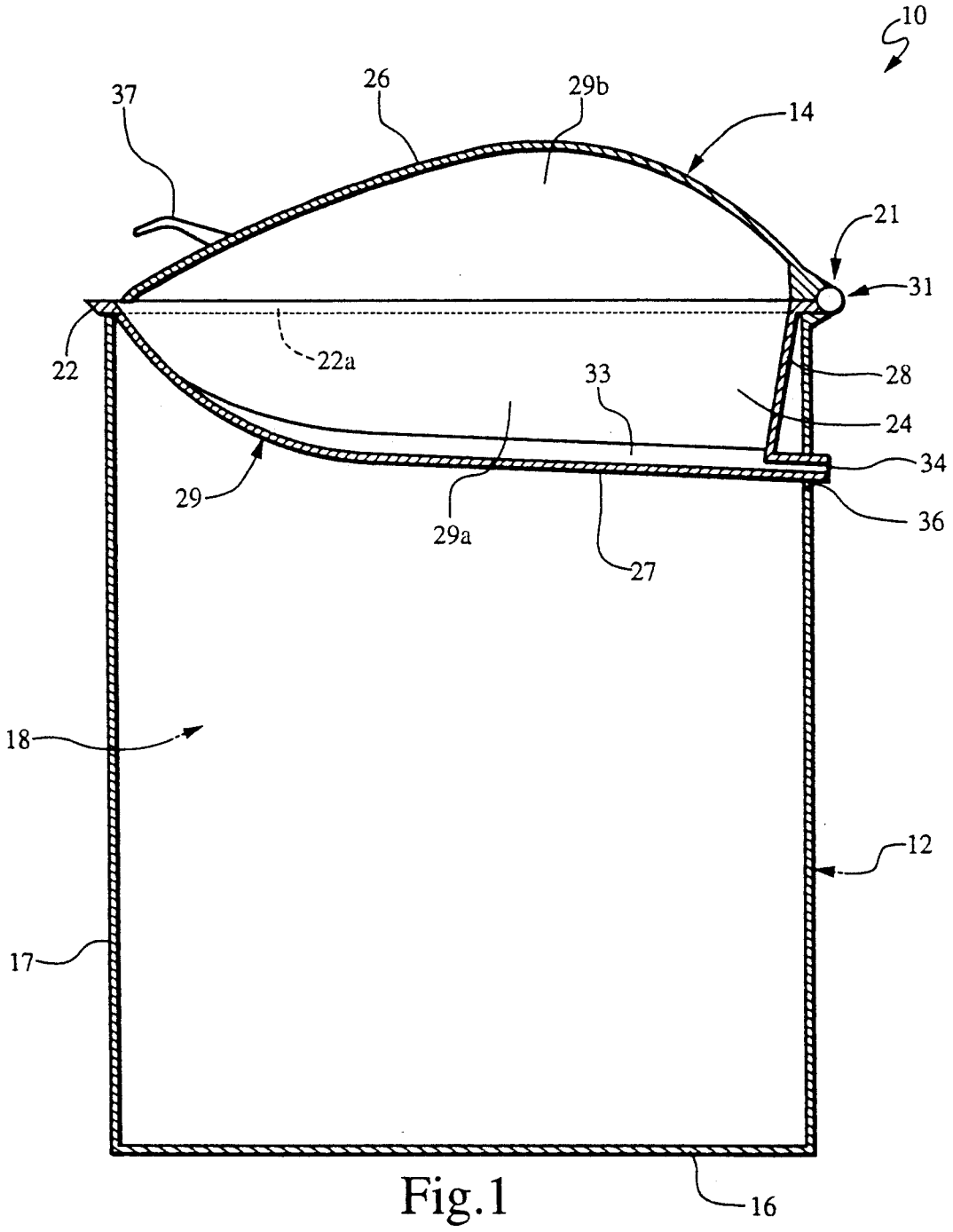
FIG. 1 schematically illustrates a chambered container according to a presently preferred embodiment of the invention with the lid thereof in a closed position.
Figure 2:
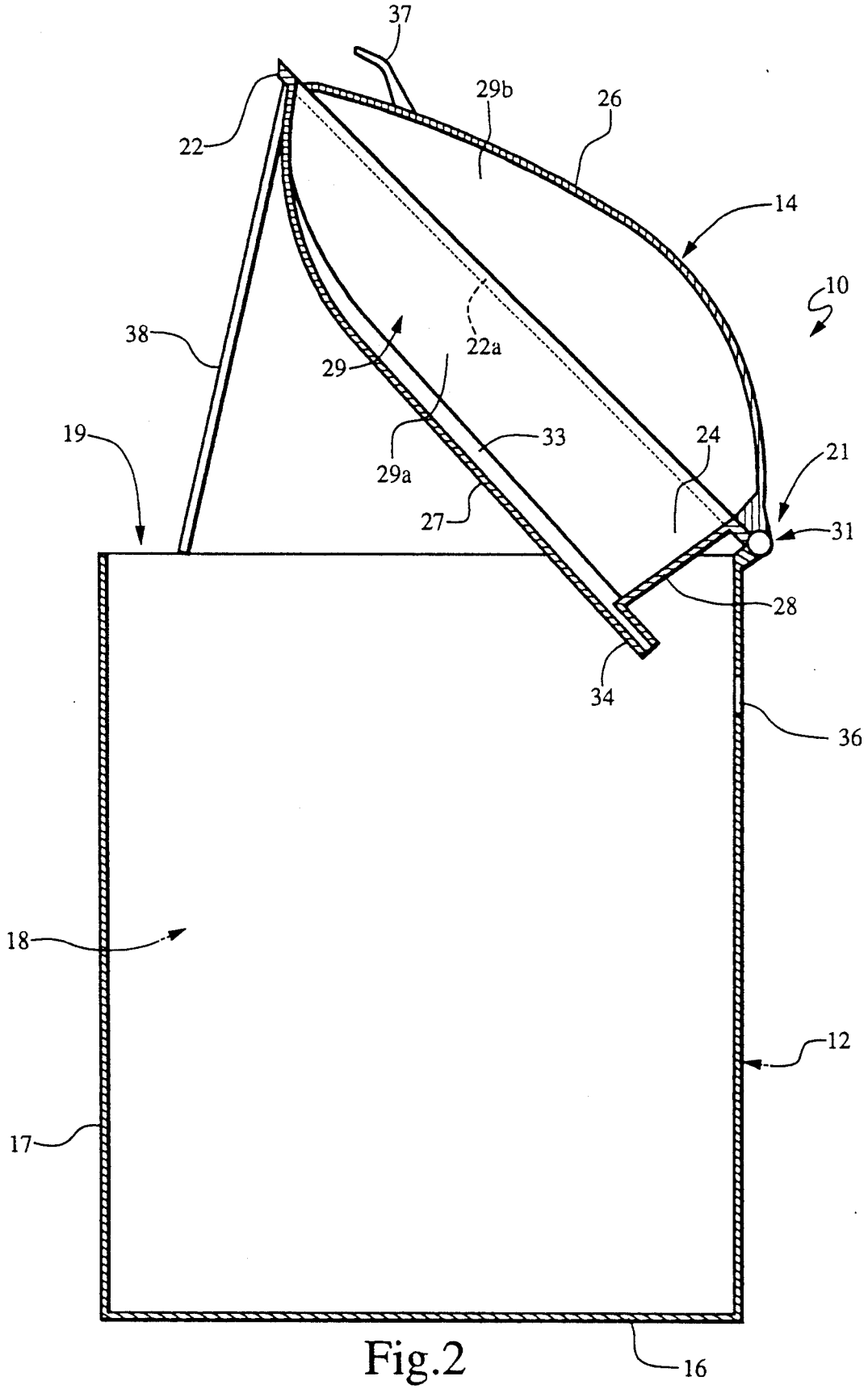
FIG. 2 illustrates the container of FIG. 1 with the lid thereof in an open position.
Figure 3:
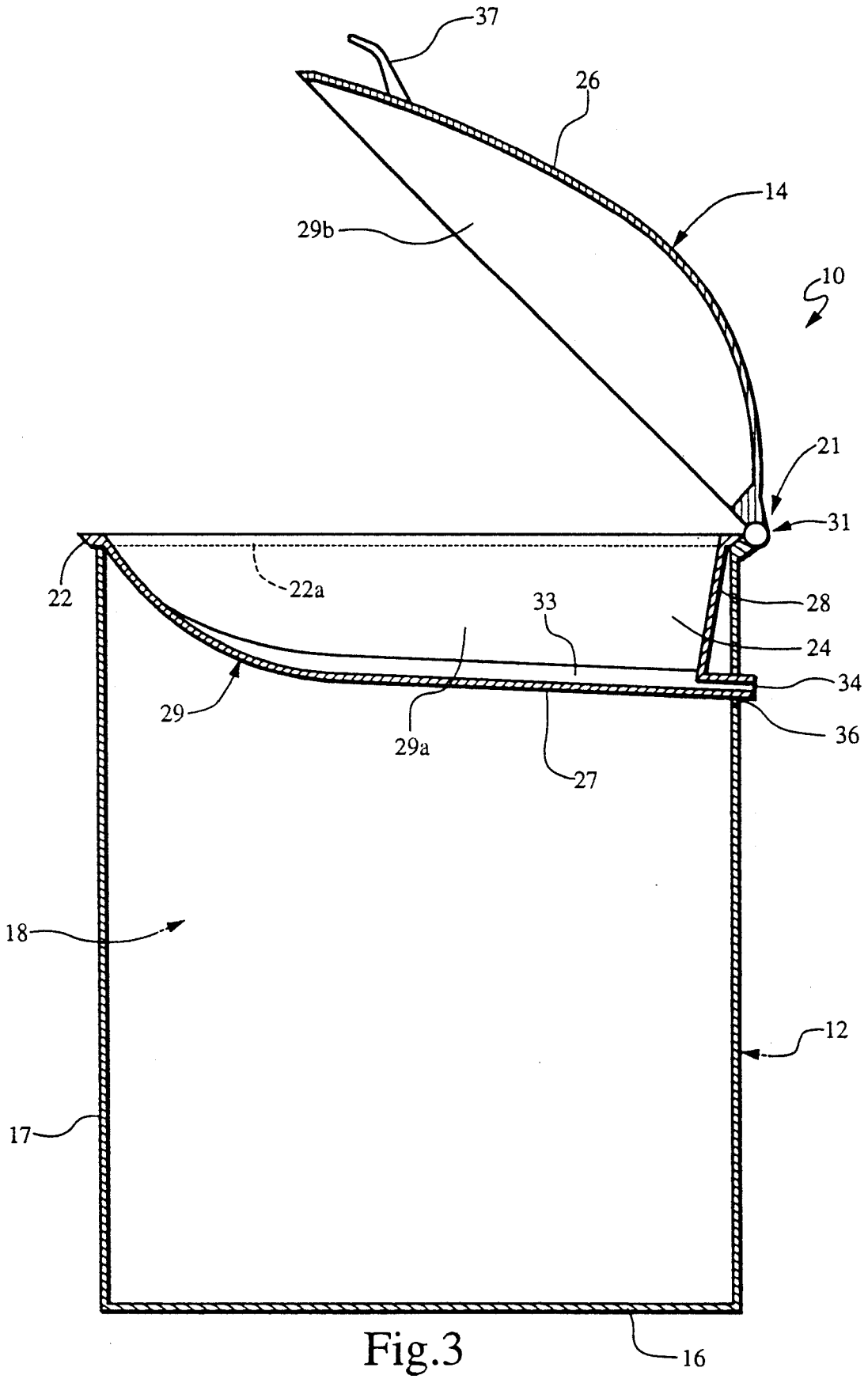
FIG. 3 illustrates the container of FIGS. 1 and 2 with the lid thereof in a closed position and a cover of the lid in an open position.

FIGS. 1-3 schematically illustrate a chambered container for storing separated solid waste according to a presently preferred embodiment of the invention. The container is generally designated by reference number 10 and includes a conventional container body 12 and a lid 14.

As shown in FIGS. 1-3, container body 12 is of generally cylindrical shape and comprises a bottom wall 16 and a cylindrical side wall 17 which define a first chamber 18 within the body. The top end of body 12 defines an opening 19 to provide access to the first chamber 18.

Lid 14 functions as a closure member for body 12. More particularly, one side of lid 14 (hereinafter referred to as the back side) is attached to body 12 by a first hinge means 21 for pivotal movement relative to the body between a first closed position, shown in FIG. 1, covering open end 19 (FIG. 2) and closing first chamber 18, and a second, open position, shown in FIG. 2, providing access to first chamber 18. As best shown in FIGS. 1 and 5B, lid 14 includes an annular flange 22 which is adapted to seat on the annular upper edge of body 12 when in the first, closed position to fully close the first chamber. As will be explained hereinafter, flange portions 22*a* on either side of the lid preferably extend somewhat beyond the upper edge of body 12 when the lid is in the first, closed position.

Figure 4A:
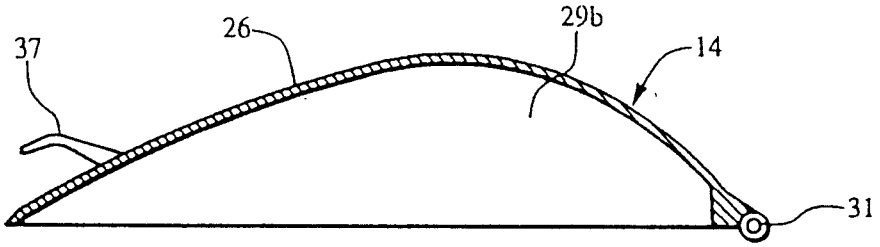
FIGS. 4A and 4B are side views of the cover and base portions, respectively, of the lid of FIGS. 1-3.
Figure 4B:
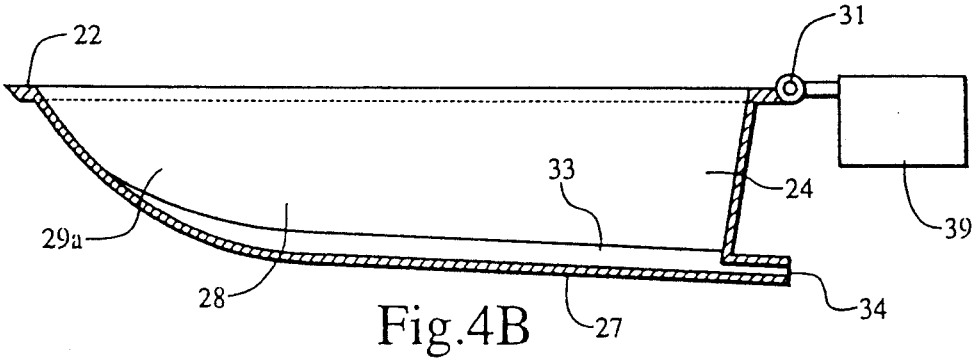
Figure 5A:
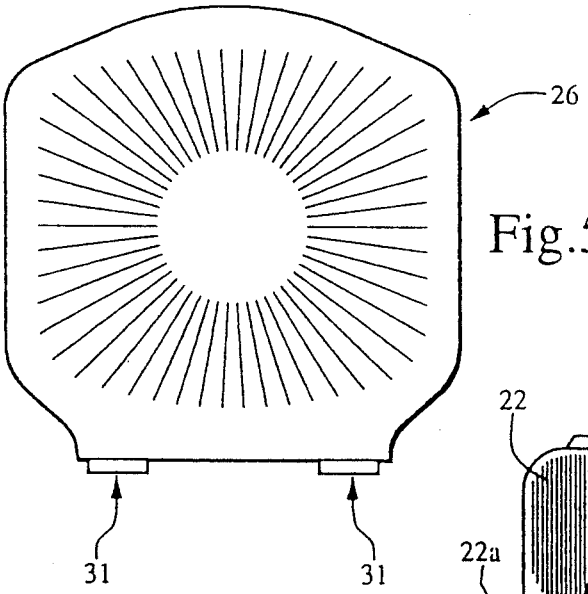
FIGS. 5A and 5B are top views of the cover and base portions, respectively, of the lid of FIGS. 1-3.
Figure 5B:
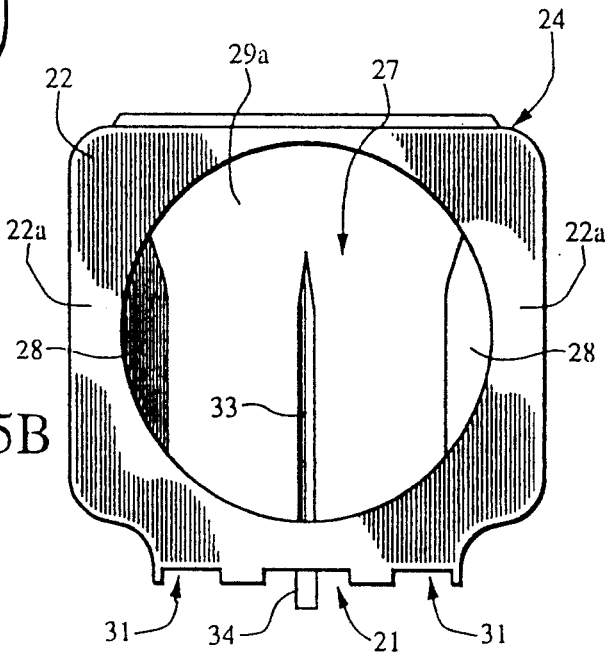

Lid 14, which is also illustrated in separated side view in FIGS. 4A and 4B and in separated top view in FIGS. 5A and 5B, is of clam-shaped construction and comprises a base portion 24 and a cover 26. Base portion 24 includes a bottom wall 27 and side walls 28 which define a portion 29*a* of a second chamber 29 within the lid.

Cover 26 functions as a closure member for base portion 24 and is connected to base portion 24 along the back side thereof by a second hinge means 31 for pivotal movement relative to the base portion between a first, closed position, shown in FIGS. 1 and 2, closing the second chamber, and a second, open position shown in FIG. 3, providing access to the second chamber. As shown in the FIGS., when cover 26 is in its first, closed position, it will seat on the upper surface of annular flange 22 to fully close the second chamber.

As also illustrated in the FIGS., cover 26 is preferably of dome-shaped construction so as to also define a portion 29*b* of second chamber 29 to thereby increase the capacity of chamber 29.

As best shown in FIG. 4B, the bottom wall 27 of base portion 24 is inclined downwardly somewhat toward the back thereof, and, as shown in FIG. 5B, the side walls 28 thereof are angled inwardly and downwardly somewhat to define with the bottom wall a central groove 33. A tube 34 extends outwardly from the base portion in alignment with groove 33 to function as a drain to remove any water or other liquid that may accumulate in the second chamber. As shown in FIG. 1, a hole 36 is provided in the side wall 17 of body 12 through which tube 34 will extend when the lid 14 is in its closed position.

Chambered container 10 is particularly designed to store separated solid waste. For example, the first, larger chamber 18 can conveniently store normal household garbage or a bulky recyclable such as yard waste; while the second, smaller chamber 29 can store bagged recyclables such as aluminum cans, glass bottles or the like. To deposit waste into the first chamber, the entire lid 14 is raised to its second open position, as shown in FIG. 2, to provide access to the second chamber. This can be easily done by simply grasping the flange 22 at the front end of the lid and raising the lid. To deposit waste into the second chamber, only the cover 26 of the lid is raised to its second, open position as shown in FIG. 3, while leaving the base portion 24 in its first, closed position. A handle or the like may be molded into or otherwise provided on the cover as schematically shown at 37 in FIG. 1, to facilitate raising of the cover.

In constructing the chambered container of the present invention, it may be desirable to incorporate suitable means for counterbalancing the weight of the lid and its contents. For example, a lead weight or other weight increasing structure may be molded into the base portion of the lid rearwardly of the hinge pivot point as schematically illustrated at 39 in FIG. 4B, and/or the hinge pivot point of the lid can be moved forwardly.

To allow easy access to the first chamber by the consumer, lid 14 can be held in an open position by an automatic drop leg such as illustrated at 38 in FIG. 2 which can be positioned on the upper edge of the body to hold the lid open. The lid can easily be closed by holding the lid with one hand and tripping the drop leg with the other hand. It should be noted that the lid should normally not be opened to a vertical orientation as this might allow the contents of the second chamber to fall out; and appropriate structure can be provided on the container, if desired, to limit the extent to which the lid can be raised.

The chambered container 10 of the present invention provides a convenient and effective way for a homeowner or other consumer to separate recyclable waste from ordinary trash or to separate different types of recyclable waste. The overall container is configured substantially the same as and does not require any more space than an ordinary trash can. It is also preferably formed of a sturdy, lightweight plastic for durability and ease in handling.

Although container 10 is illustrated as being of cylindrical shape, it could also be formed in other convenient shapes. For example, FIGS. 6A and 6B illustrate a lid 40 for a rectangular-shaped container. Lid 40 is generally similar in construction and operation to lid 14 illustrated in FIGS. 1-5 and includes a trough-shaped base portion 42 and a dome-shaped cover portion 44 connected together at one end thereof by a hinge 46 to provide a generally rectangular-shaped, clam shell configuration. The base portion includes side flanges 48 for seating the lid onto a rectangular-shaped container.

An important aspect of the present invention is that the chambered containers 10 and 40 are compatible with conventional automated trash collection vehicles which utilize a robotic arm to hoist containers up and over the vehicle to empty the contents thereof into the vehicle.

Figure 8:
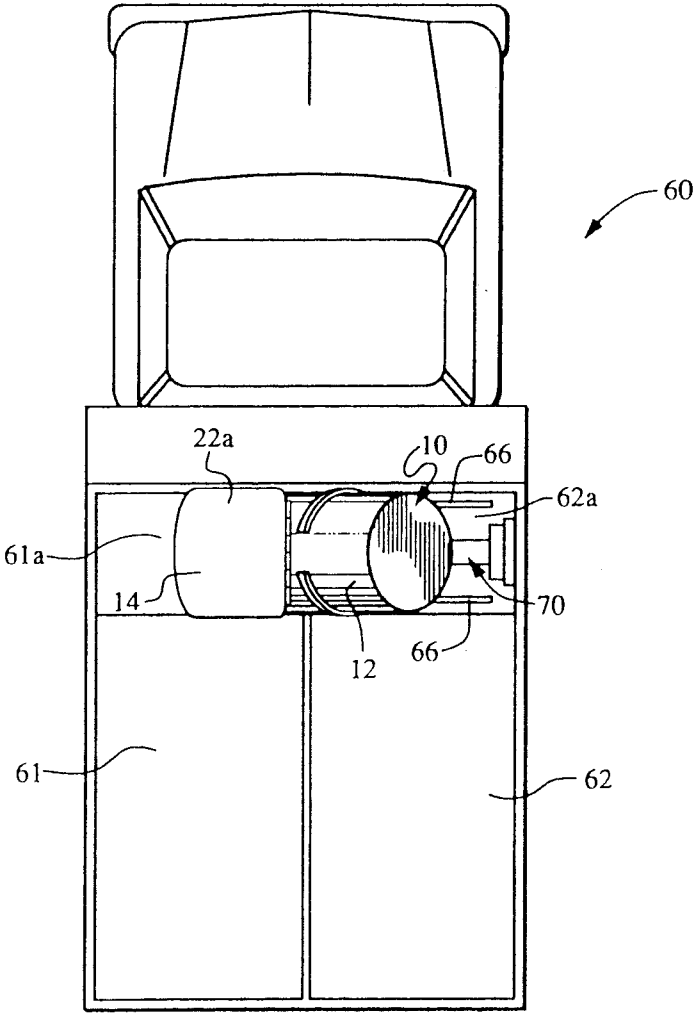
FIG. 8 illustrates the trash collection vehicle of FIG. 7 in the process of emptying the chambered container of FIGS. 1-3 thereinto.
Figure 7:
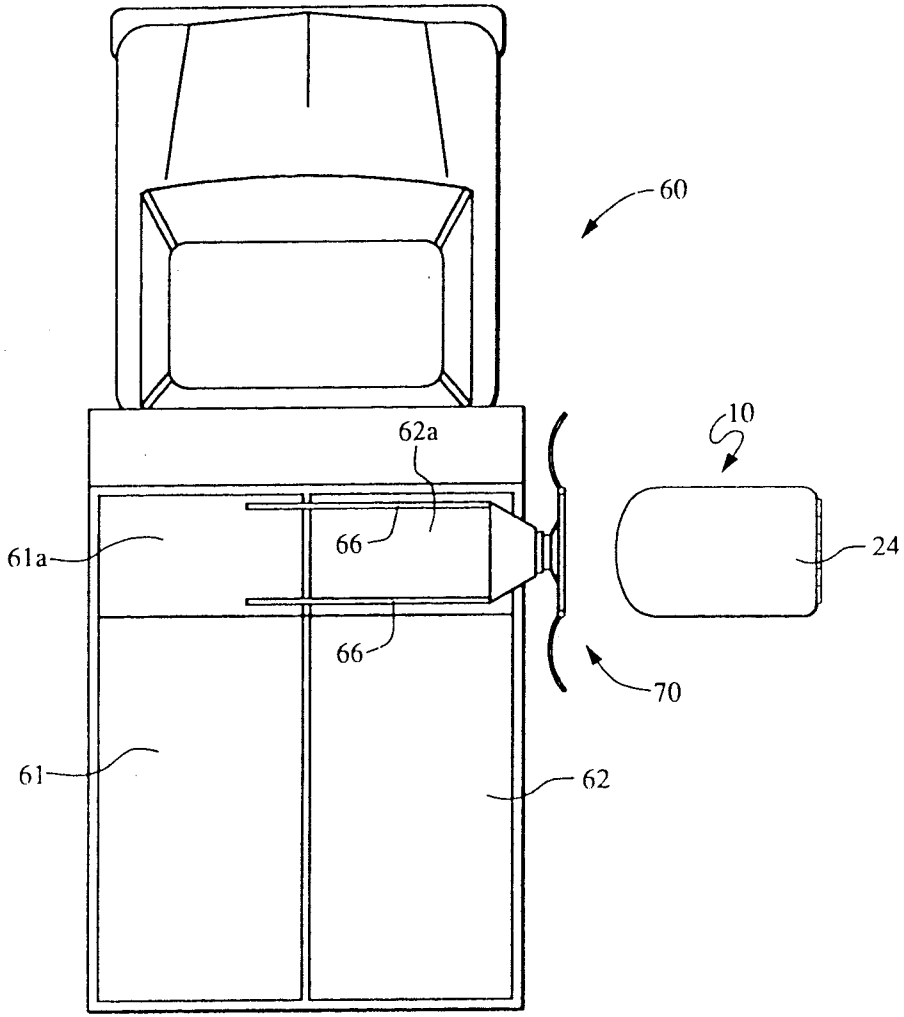
FIG. 7 schematically illustrates a top view of a trash collection vehicle according to the present invention.

In accordance with the present invention, a collection vehicle is utilized that includes two compartments for collecting the separated waste stored in the two chambers of container 10. More specifically, as schematically illustrated in FIG. 7, the collection vehicle, generally designated by reference number 60, includes left and right side compartments 61 and 62. Although shown as being of equal size, in practice the left and right sides are divided into areas proportioned according to the expected proportion of the items being separated. Preferably, separate compaction mechanisms (not shown in the FIGS.) are provided to compact the collected waste in each compartment of the vehicle. As shown in FIGS. 7 and 8, access to the compartments 61 and 62 is provided at the top of the vehicle through openings 61*a* and 62*a*, respectively.

As shown in FIGS. 7 and 8, vehicle 60 is also provided with a pair of spaced guide rails 66 which extend across the opening 62*a* of the right side compartment 62 of the vehicle and partially across the opening 61*a* of the left side compartment 61. As shown in FIGS. 9A and 9B, guide rails 66 each include a generally horizontal first portion 66*a* which extends substantially across opening 62*a*, and a downwardly inclined second portion 66*b* which extends partially across opening 61*a* and slightly into compartment 61.

In operation, vehicle 60 is first positioned relative to a container 10 as shown in FIG. 7 so that a robot arm 70 thereof can clamp around the container and hoist it up and over the vehicle in a conventional manner to the position shown in FIG. 8. As the container is being turned over by robot arm 70, flange portions 22*a* on either side of lid 14 contact the horizontal first portion 66*a* of guide rails 66 as shown in FIG. 9A. The guide rail portions 66*a* maintain the lid in a substantially horizontal orientation as the body of the container 10 continues to be turned over between the rails. As the body continues to be turned over, the body will pivot downwardly relative to the lid as shown in FIG. 9A, uncovering the first chamber and allowing the contents thereof to drop into the right side compartment 62 of the vehicle by gravity. As the robot arm continues to move the container toward the center of the vehicle, because the robot arm has turned container 10 completely over, the pivot hinge 31 has been forced from the right to the left in the FIG. pushing the lid 14 ahead of it. When the body 12 is fully tipped, the hinge will have forced the lid 14 to the portion 66*b* on the guide rails 66, where they turn downward into the second compartment 61*a* allowing the contents of lid 14 to fall by gravity into compartment 61*a*. Thus, with the system of the present invention, the contents of the container are emptied into and maintained in separated form in the collection vehicle in a fully automatic manner.

Preferably, the rear of the vehicle is divided into two dumping doors (not shown in the FIGS.) so that the contents of each compartment can either be dumped separately or dumped together into a divided processing bin. The truck can dump recyclables at a recycling center; or, if conventional solid waste is collected by the truck as well as recyclables, the solid waste can be dumped at a landfill or incinerator thus creating source separation in an automated collection compaction procedure.

While described primarily as a separated waste collection system for home or consumer application, the present invention could also be readily utilized in commercial applications utilizing large, commercial-sized containers.

While what has been described comprise presently preferred embodiments of the invention, it should be understood that the invention could take numerous other forms. Accordingly, it should be recognized that the invention should be limited only insofar as is required by the scope of the following claims.

I claim:

1. A chambered container for storing separated, solid waste comprising:

a container body defining a first chamber therein for receiving a first solid waste; and a lid for covering said container body, said lid being connected to said container body and being movable between a first, closed position closing said first chamber, and a second, open position providing access to said first chamber, and including a flange for seating on an upper edge of said container body to fully close said first chamber when said lid is in said first, closed position, said lid including a base portion for defining a second chamber therein for receiving a second solid waste, said base portion extending into said first chamber when said lid is in said first, closed position, and a cover for covering said base portion, said cover being connected to said base portion and being movable between a first, closed state for closing said second chamber and a second, open state for providing access to said second chamber, said cover seating on said flange to fully close said second chamber when said cover is in said first, closed state.

2. The chambered container of claim 1 wherein said lid further includes drain means for draining water or other liquid from said second chamber.

3. The chambered container of claim 1 wherein said cover is dome-shaped to define a portion of said second chamber when said cover is in its first, closed state, said cover extending outside of said first chamber when said lid is in its first, closed position.

4. The chambered container of claim 1 wherein said container body is of generally cylindrical shape.

5. A chambered container for storing separated, solid waste comprising:

a container body defining a first chamber therein for receiving a first solid waste; and a lid for covering said container body, said lid being connected to said container body and being movable between a first, closed position closing said first chamber, and a second, open position providing access to said first chamber, said lid including a base portion for defining a second chamber therein for receiving a second solid waste, said base portion extending into said first chamber when said lid is in said first, closed position, and a cover for covering said base portion, said cover being connected to said base portion and being movable between a first, closed state for closing said second chamber and a second, open state for providing access to said second chamber, and further including first hinge means for connecting said lid to said container body for pivotal movement between said first, closed position closing said first chamber, and said second, open position for providing access to said first chamber; and second hinge means for connecting said cover to said base portion for pivotal movement between said first, closed state closing said second chamber, and said second, open state for providing access to said second chamber, said first and second hinge means being on the same side of said container.

6. The chambered container of claim 5 wherein said first and second hinge means include common hinge structure shared by said first and second hinge means.

7. A chambered container for storing separated, solid waste comprising:

a container body defining a first chamber therein for receiving a first solid waste;

a lid for covering said first chamber, said lid including means for defining a second chamber therein for receiving a second solid waste, said lid comprising a base portion for defining said second chamber and a cover for covering said second chamber; and drain means for draining water or other liquid from said second chamber, said drain means including a drain tube extending from said base portion, and wherein said container body includes a hole in a wall thereof for receiving said drain tube when said lid is in its first, closed position.

8. The chambered container of claim 7 wherein said drain tube extends outwardly from a side wall of said base portion, and wherein said hole in said container body is in a side wall of said container body.

9. A chambered container for storing separated materials comprising:

a container body defining a first chamber therein for storing a first material; and a lid connected to said container body by first hinge means for covering said container body and being pivotally movable between a first, closed position closing said first chamber, and a second, open position providing access to said first chamber, said lid including a base portion extending into said first chamber when said lid is in said first, closed position for defining a second chamber therein for storing a second material, and a cover connected to said base portion by second hinge means for covering said base portion, said cover being pivotally movable between a first, closed state for closing said second chamber and a second, open state for providing access to said second chamber, wherein said first and second hinge means are on the same side of said container and share common hinge structure.

10. The chambered container of claim 9 wherein said cover is dome-shaped to define a portion of said second chamber when said cover is in its first, closed state, said cover extending outside of said first chamber when said lid is in its first, closed position.

11. The chambered container of claim 9 wherein said lid includes an annular flange for seating on an upper edge of said container body to fully close said first chamber when said lid is in said first, closed position.

12. The chambered container of claim 11 wherein said cover seats on said annular flange to fully close said second chamber when said cover is in said first, closed state.

* * * * *